US008586846B2

(12) United States Patent
Ehmann

(10) Patent No.: US 8,586,846 B2
(45) Date of Patent: Nov. 19, 2013

(54) SET OF SNARES FOR A DRUM

(76) Inventor: Heiner Ehmann, Weiterstadt (DE)

( * ) Notice: Subject to any disclaimer, the term of this patent is extended or adjusted under 35 U.S.C. 154(b) by 0 days.

(21) Appl. No.: 13/557,360

(22) Filed: Jul. 25, 2012

(65) Prior Publication Data

US 2013/0112061 A1 May 9, 2013

(30) Foreign Application Priority Data

Nov. 9, 2011 (DE) ..... 10 2011 117 991

(51) Int. Cl.
*G10D 13/02* (2006.01)

(52) U.S. Cl.
USPC ..... 84/415

(58) Field of Classification Search
USPC ..... 84/411 R, 411 P, 411 M, 415–417
See application file for complete search history.

(56) References Cited

U.S. PATENT DOCUMENTS

| | | | | |
|---|---|---|---|---|
| 1,816,328 | A * | 7/1931 | Enos | 84/415 |
| 2,604,001 | A | 1/1949 | Lewan | |
| 4,095,505 | A | 6/1978 | Hoey et al. | |
| 6,091,010 | A | 7/2000 | Gauger | |

FOREIGN PATENT DOCUMENTS

| | | |
|---|---|---|
| DE | 2713700 | 10/1978 |

* cited by examiner

*Primary Examiner* — Kimberly Lockett
(74) *Attorney, Agent, or Firm* — Kaplan Breyer Schwarz & Ottesen, LLP

(57) ABSTRACT

A set of snares for a drum comprising an elongated first wire with two ends to be placed at least in part against a surface of a head of the drum and a first and one second fastening means for fastening the set of snares to the snare drum, wherein the first end of the first wire is attached to the first fastening means and the second end of the first wire is attached to the second fastening means, wherein the first wire runs between the two fastening means, wherein the first wire is shaped such that, at least along a partial section of the first wire, it follows an envelope body, the outer dimensions of which in the assembled state of the set of snares on the drum vary in a plane extending from the first fastening means to the second fastening means and intersecting the surface of the head of the drum.

9 Claims, 2 Drawing Sheets

SET OF SNARES FOR A DRUM

CROSS-REFERENCE TO RELATED APPLICATIONS

German patent application DE 10 2011 117 991.0, filed on Nov. 9, 2011, is incorporated herein by reference.

FIELD OF THE INVENTION

The invention relates to a set of snares for a drum, in particular for a snare drum.

BACKGROUND OF THE INVENTION

Side drums are also referred to as snare drums and are a component of drum sets for producing music. They produce the cracking sound that is desirable with orchestral or marching music, for instance.

Snare drums usually have a frame shaped in the manner of a shell of metal, wood or plastic which is generally provided with two heads, i.e., with an upper head, also called a drum head, which can be struck by a drummer in order to generate vibrations, as well as with a lower head, also called a resonant head, which is excited by these vibrations.

Sets of snares for snare drums of the above-mentioned type are also referred to as snare sets. They generate the cracking sound typical for snare drums. For sound generation, sets of snares generally comprise a plurality of elongated wires lying next to one another, as a rule of metal, plastic or gut, which can be excited to form vibrations. These wires, also called snare wires, are generally shaped to form wires or strings of constant thickness.

Sets of snares should be fastened to drums such that the wires of the set of snares bear directly against the surface of a head of the drum, usually the resonant head of a snare drum. When the drum is struck, the wires of the set of snares are thus excited to resonate as well, and thus to rack or rattle, in that vibrations of the head, against the surface of which the set of snares bears, are transferred to the wires of the set of snares.

The fastening of a set of snares to the drum is carried out on both sides of the drum frame. The set of snares thereby usually rests in a recess a few millimeters deep and several centimeters wide, lying diametrically opposite in the drum frame, which is also referred to as a snare bed. The set of snares can be correspondingly tensioned with a tensioning means, such as, for example, a toggle lever mechanism or the like, so that the individual wires thereof can bear against the surface of the head of the drum.

A tension of the set of snares or the wires thereof that is too loose can hereby mean that the wires of the set of snares do not bear against the head of the drum or do not bear with sufficient bearing force against the head of the drum, i.e. in particular against the resonant head of the snare drums, which can be expressed in a sound that is too weak. Also in this case the wires of the set of snares of the drum can pick up vibrations from other musical instruments from the surroundings of the drum set and thus excite the set of snares and a resonant head of a snare drum to undesirable interfering background noise, such as, for example, booming or rattling noises. In particular a set of snares bearing poorly against the head "booms" or "rattles" unpleasantly while being played at certain frequency ranges if other drums, such as, for instance, a bass of the drum set are also being played.

In order to reliably ensure a good bearing of the wires of a set of snares against the head of a snare drum, these wires therefore have to be firmly tensioned. However, an excessively taut tensioning of the wires of the set of snares can hereby lead to a sharp, dry even "dead" sound of the snare drum as well as reducing too much the sound response, so that in particular a snare drum in which the set of snares bears too tightly against the resonant head is less sensitive to weak strokes.

Attempts to improve the bearing behavior of sets of snares against heads of drums, in particular resonant heads of snare drums, for example, with means for increasing the bearing forces of the snare wires without having to tension them too tightly, for example, by means of attaching pads to the head from below, such as, for example, strips or adhesive tapes, has hitherto lead rather to a negative change or to a damping of the sound behavior of snare drums instead of an improved sound behavior.

SUMMARY OF THE INVENTION

As a result, the object of the invention against the background of the disclosed prior art is to create an improved set of snares for drums, in particular for snare drums with a resonant head, which ensures a secure bearing of snare wires against a head of the drum. Furthermore, in a preferred embodiment a set of snares of this type should be easy to produce, to attach and to tension.

Essential advantages of the invention and the individual embodiments or further developments thereof are accordingly based on the fact that snare wires bear well against the head even with low tension, and the drum has a broader sound range and/or frequency range, wherein this can be played without interfering background noise and there is no or only a slight change or damping of the sound behavior. Furthermore, the invention makes it possible to produce a fitting and suitable set of snares for drums with and without a snare bed, in particular to produce a customized set of snares that reproduces a contour of the resonant head of a snare drum.

The object of the invention is accordingly attained by a set of snares for a drum, in particular for a snare drum, wherein the set of snares comprises at least one elongated first wire, to be laid at least in part against a surface of a head of the drum, with two ends and at least one first and one second fastening means for fastening the set of snares to the snare drum, wherein the first end of the first wire is attached to the first fastening means and the second end of the first wire is attached to the second fastening means, wherein the first wire runs between the two fastening means, whereby a longitudinal axis of the first wire is established, and wherein the course of the first wire is shaped such that, at least along a partial section of the first wire, expediently a center partial section of the first wire, it follows an envelope body, the outer dimensions of which in the assembled state of the set of snares on the drum vary in a plane extending from the first fastening means to the second fastening means and intersecting the surface of the head of the drum.

In a further embodiment of the invention, at least along this partial section the first wire is curved in a helical manner around its longitudinal axis, shaped in an undulating or tooth-like manner and/or has different thicknesses.

In a further development of the set of snares according to the invention, the dimensions of the envelope body along this partial section from the first end in the direction of the second end first increase and subsequently decrease again.

Furthermore, the increasing dimensions of this partial section can essentially conically increase and/or the decreasing dimensions of this partial section can essentially conically decrease.

In a particularly preferred further development of the set of snares according to the invention, dimensions of the envelope body along this partial section are dimensioned such that essentially a bulge-shaped longitudinal profile of the first wire and/or of the course of the first wire is embodied.

In particular, in a further embodiment of the invention, the largest dimensions of the envelope body along this partial section can be arranged essentially in the center of the longitudinal side of the first wire.

In a particularly preferred further development, the surface of the head, in particular of the resonant head, of a drum, against which the elongated first wire is to be placed, at least in part, can have a surface contour.

The at least first wire of a drum of this type can furthermore be shaped such that at least along the center partial section of the first wire it follows an envelope body, the outer dimensions of which in the assembled state of the set of snares on the drum vary in the plane extending from the first fastening means to the second fastening means and intersecting the surface of the head of the drum accordingly such that the envelope body along this partial section runs preferably parallel, but at least, however, essentially parallel to the surface contour of the head.

In a further embodiment of the invention, the set of snares comprises at least one second wire, the first end of which is attached to the first fastening means and the second end of which is attached to the second fastening means.

In a further alternative embodiment of the invention, the first and the second wire can be arranged parallel to one another and/or the geometric shape of the second wire can essentially correspond to that of the first wire or also be shaped differently from the first wire.

BRIEF DESCRIPTION OF THE DRAWINGS

Further features and advantages of the invention can be seen from the following description of preferred embodiments of sets of snares according to the invention with reference to the drawings. The drawing shows.

The invention is explained in greater detail below based on exemplary embodiments and with reference to the figures, wherein the same features or features with the same effect are provided with the same reference numbers.

DETAILED DESCRIPTION

Figure 1:
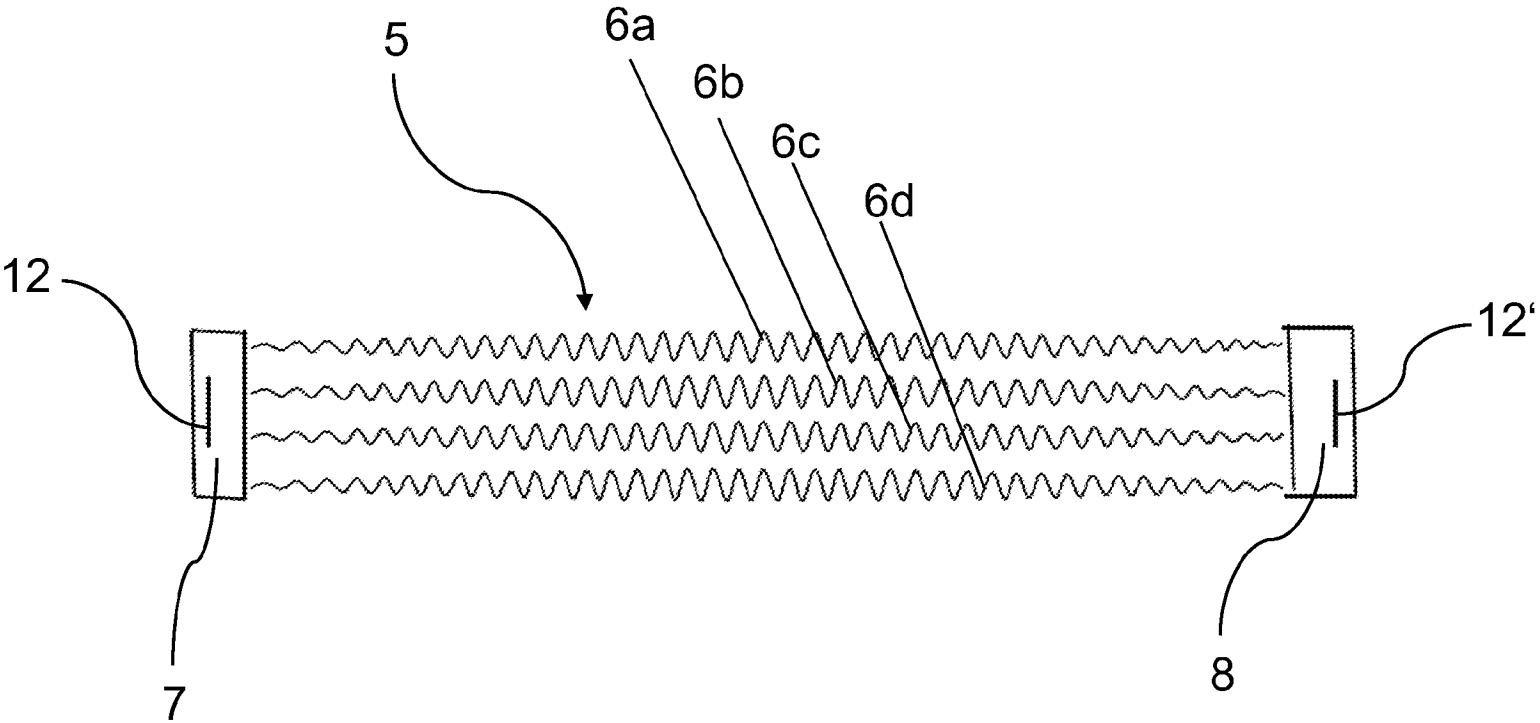
FIG. 1: a plan view of a set of snares according to one embodiment of the invention.

FIG. 1 shows a preferred embodiment of a set of snares 5 according to the invention. A total of four wires 6*a*, 6*b*, 6*c*, 6*d* are attached to the set of snares shown in FIG. 1 for sound generation, wherein respectively one end of a wire 6*a*, 6*b*, 6*c*, 6*d* is attached to a first fastening means 7 and another end of the respective wire 6*a*, 6*b*, 6*c*, 6*d* is attached to a second fastening means 8, so that the wires 6*a*, 6*b*, 6*c*, 6*d* run between the two fastening means 7, 8, whereby respective longitudinal axes of the wires are established.

The first and the second fastening means 7, 8 of the set of snares 5 shown in FIG. 1 respectively has an elongated recess 12, 12' to accommodate retaining straps 11, 11' (FIG. 2) which are not shown in FIG. 1.

The course of each of the wires 6*a*, 6*b*, 6*c*, 6*d* between the two fastening means 7 is shaped such that at least along a center partial section of the respective wire 6*a*, 6*b*, 6*c*, 6*d* they follow an envelope body, the outer dimensions of which vary, namely vary in the assembled stated of the set of snares on the drum in a plane extending from the first fastening means to the second fastening means and intersecting the surface of the head of the drum.

Figure 2:
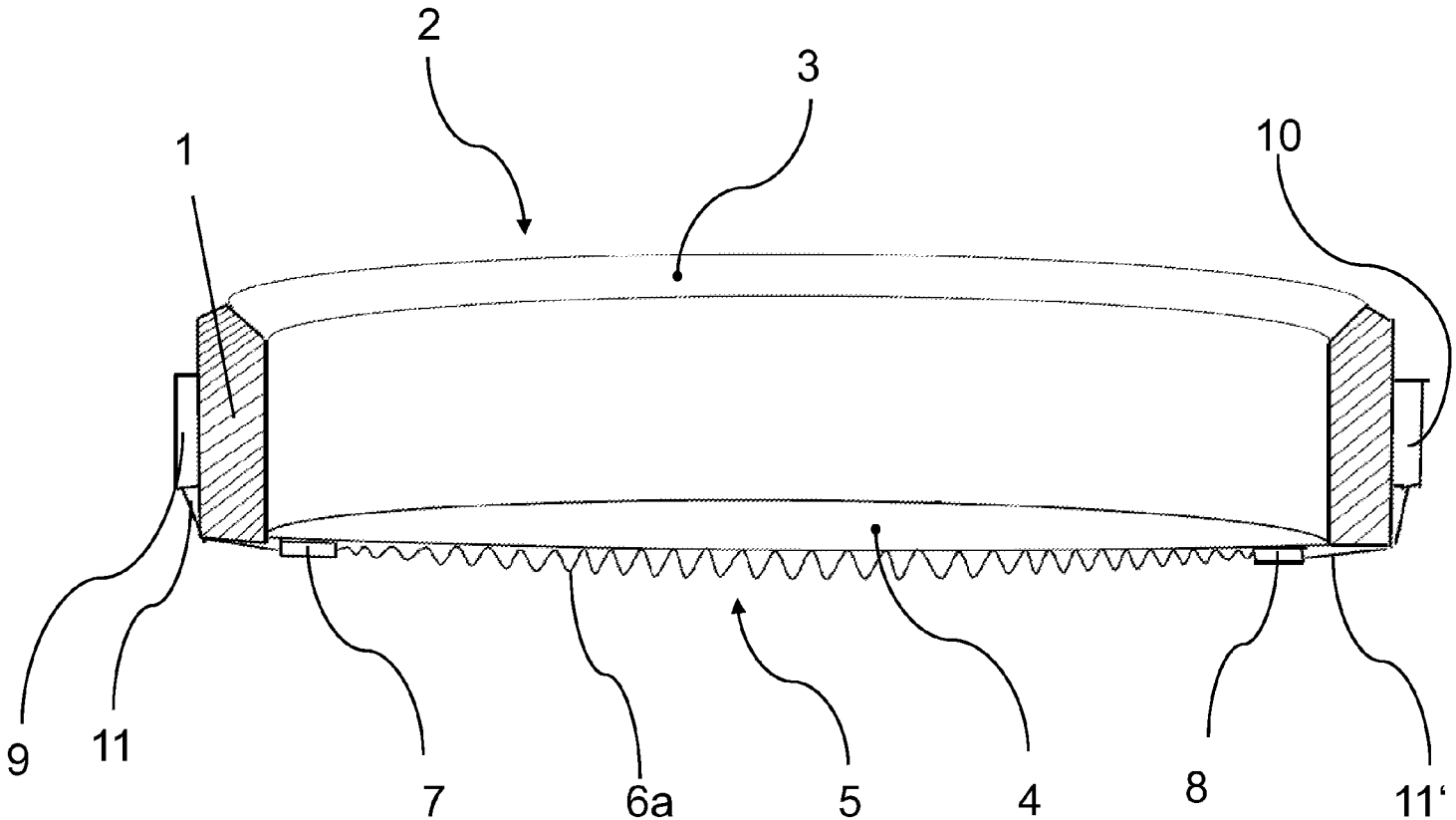
FIG. 2: a cross section through a snare drum with a set of snares attached thereto according to one embodiment of the invention.

Since FIG. 1 is a plan view of the set of snares 5, which in the assembled state bear against the surface of a head of a drum, as also shown in FIG. 2, the dimensions of the envelope body according to FIG. 1 vary consequently not only in a plane extending from the first fastening means to the second fastening means and intersecting the surface of the head of the drum, but at least in a second plane not intersecting the surface of the head of the drum.

In detail, the wires 6*a*, 6*b*, 6*c*, 6*d* of the embodiment shown in FIG. 1 of the set of snares 5 according to the invention are coiled along their entire length respectively in a helical manner about their longitudinal axes, wherein individual turns of the wires 6*a*, 6*b*, 6*c*, 6*d* respectively have different radii that initially increase and subsequently decrease again along the longitudinal direction of the wires 6*a*, 6*b*, 6*c*, 6*d*.

The dimensions of the envelope body first conically increasing and subsequently conically decreasing dimensions of the envelope body due to the helical embodiment of the wires are preferably dimensioned such that the longitudinal profile of the envelope body is embodied essentially in a bulge-shaped manner along the longitudinal direction of the individual wires 6*a*, 6*b*, 6*c*, 6*d*.

Furthermore, FIG. 1 shows that with an embodiment of this type of the set of snares 5 according to the invention, coils with the largest radii, which accordingly form the largest dimensions of the envelope body, are respectively arranged essentially in the center of the longitudinal side of the wires 6*a*, 6*b*, 6*c*, 6*d*.

Also, as can be seen from FIG. 1, the individual wires 6*a*, 6*b*, 6*c*, 6*d* can be preferably arranged parallel and/or the same geometric shape and/or arranged in the longitudinal direction in phase to one another.

Furthermore, the course of the individual wires 6*a*, 6*b*, 6*c*, 6*d* between the first and the second fastening means 7, 8 can be shaped in a use-specific manner, i.e., depending on the drum to be equipped and/or desired snare effect, such that these wires 6*a*, 6*b*, 6*c*, 6*d* either, as shown in FIG. 1, essentially over the entire length thereof follow an envelope body, the outer dimensions of which in the assembled state of the set of snares on the drum vary in a plane extending from the first fastening means to the second fastening means and intersecting the surface of the head of the drum 1, or, as not shown in FIG. 1, at least in a partial section of the individual wires 6*a*, 6*b*, 6*c*, 6*d*.

FIG. 2 shows a cross section through a round drum 1 with an assembled set of snares 5 according to a preferred embodiment of the invention.

The drum 1 shown in FIG. 2 has two heads 3, 4, wherein in the example shown this is a snare drum that has a drum head 3 and a resonant head 4, both of which are attached in a tensioned manner to the frame 2 of the drum 1. The drum head is thereby attached to the upper edge of the frame 2 of the drum 1, and the resonant head 4 is attached to the lower edge thereof. The set of snares 5 hereby bears against the surface of the resonant head 4.

It should be noted that a set of snares usually bears against the surface of a head that lies on the side opposite the side for striking the drum.

The set of snares 5 according to FIG. 2 consequently bears against the surface directed downwards of the resonant head 4.

In the case of the set of snares 5 according to FIG. 2, the course of a first wire 6*a* is likewise shaped such that at least along a partial section of the first wire 6*a*, in the example shown along a center partial section of the first wire 6*a*, it follows an envelope body, the outer dimensions of which in the assembled state of the set of snares on the drum vary in a plane extending from the first fastening means 7 to the second fastening means 8 and intersecting the head of the drum, i.e., according to FIG. 2, the resonant head 4.

Only a first wire 6*a* can be seen in FIG. 2. Further wires attached to the set of snares 5, expediently with the same geometric shape, are hidden by the first wire 6*a* and therefore not visible in FIG. 2.

It should be noted that the set of snares 5, shown in FIG. 2, bearing against the resonant head 4 of the drum 1, according to a further embodiment of the invention with correspondingly adapted fastening means of the drum, in principle can also bear against the drum head 3 of the drum 5.

For the purpose of a tensioned attachment, a first fastening means 7 and a second fastening means 8 of the set of snares 5 are respectively connected with a retaining strap 11, 11' to a first tensioning means 9 and a second tensioning means 10 attached to the frame 2 of the drum 1. By means of this first tensioning means and this second tensioning means 9, 10 lying diametrically opposite one another, the set of snares 5 shown in FIG. 2 or the wires 6*a* attached thereto are tensioned, wherein these wires 6*a* preferably in turn bear closely against the cross-sectional profile of the resonant head 4 of the drum 1 and therefore accordingly adopt overall a slightly arched course to the surface of the resonant head 4 between the fastening means 7 and 8.

Since FIG. 2 is a cross-sectional view through a snare drum, it can be directly seen therefrom that the dimensions of the envelope body of the wires 6*a* according to FIG. 2 consequently vary along a partial section at least in a plane extending from the first fastening means to the second fastening means and intersecting the surface of the head of the drum.

In FIG. 2 the course of the wire 6*a* at least along this partial section is shaped in an undulating manner, wherein the dimensions of the envelope body are defined by the distances between the wave peaks and the wave troughs. In an alternative modification, however, e.g., a toothlike course of the wire 6*a*, at least along this partial section, is also within the scope of the invention.

In principle the dimensions of the envelope body of the wires 6*a* according to FIG. 2, however, can also vary in a second plane not intersecting the surface of the head of the drum.

In this case, the wires 6*a* of the embodiment shown in FIG. 2 can have a course corresponding to the wires of the set of snares 5 shown in FIG. 1. In an alternative modification, however, in this case, e.g., a set of snares with wires is also within the scope of the invention which according to the desired dimensions of the envelope body respectively have different thicknesses along their length.

It is also shown by the embodiment according to FIG. 2 that the wires or the course of the wires are expediently embodied such that the dimensions of the envelope body coming from the first fastening means 7 in the direction of the second fastening means 8 in turn initially increase conically and subsequently decrease conically. Furthermore, the dimensions of the envelope body are preferably dimensioned such that the longitudinal profile of the envelope body is essentially embodied in a bulge-shaped manner along the longitudinal direction of the individual wires 6*a*.

Furthermore, FIG. 2 shows an embodiment in which the largest dimensions of the envelope body are respectively arranged essentially in the center of the longitudinal side of the wires (6*a*). As already mentioned, with a helical course of the wires, this can be carried out by corresponding dimensioning of the radii of the individual turns, in the case of an undulating course of the wires, by corresponding dimensioning of the distances between the wave peaks and with the use of wires with respectively varying thicknesses by corresponding dimensioning of the wire diameter.

Furthermore, the course of the individual wires 6*a* between the first and the second fastening means 7, 8 can be shaped such that these wires 6*a* either according to FIG. 2 essentially over their entire length follow an envelope body, the outer dimensions of which in the assembled state of the set of snares on the drum vary in a plane extending from the first fastening means to the second fastening means and intersecting the surface of the head of the drum 1, or, alternatively to FIG. 2, at least along a partial section of the individual wires 6*a*.

The first wire 6*a* shown in FIG. 2 as well as further wires, not shown, of the set of snares 5, due to the longitudinal profile of the envelope body of the individual wires 6*a* embodied essentially in a bulge-shaped manner, at least along a partial section of the wires 6*a* bear directly against the resonant head 4 of the drum 1, in particular against partial sections in the center of the respective wires 6*a*.

Furthermore, the surface of the head, in particular of the resonant head 4 of a drum 1, as shown in FIG. 2, can embody, e.g., a domed surface contour.

In FIG. 2 the first wire 6*a* as well as further wires, not shown, of such a drum, are therefore preferably shaped such that they define an envelope body at least along the center partial section of the wires, the outer dimensions of which envelope body vary in a plane extending from the first fastening means to the second fastening means and intersecting the surface of the head of the drum, and consequently follow an envelope body, which at least along this center partial section runs preferably parallel, at least, however, essentially parallel to the surface contour of the resonant head 4.

The embodiment of a set of snares 5 according to the invention shown in FIG. 2 thus ensures that the wires 6*a* of the set of snares 5 at least along a partial section bear directly against the head 4 of the drum 1.

Based on the embodiments of the invention described with reference to FIGS. 1 and 2, consequently vibrations picked up from other musical instruments in the surroundings of the drum set do not lead to a resonating of the wires 6*a*, 6*b*, 6*c*, 6*d*, which is why a drum 1 according to the invention, which is equipped with a set of snares according to the invention, does not cause any interfering background noise or at least causes reduced interfering background noise.

List of Reference Numbers

1. Drum
2. Frame
3. Drum head
4. Resonant head
5. Set of snares
6*a* First wire
6*b* Second wire
6*c* Third wire
6*d* Fourth wire
7. First fastening means
8. Second fastening means
9. First tensioning means
10. Second tensioning means
11, 11' Retaining strap
12, 12' Recess

What is claimed is:

1. A set of snares for a drum comprising:

at least one elongated first wire with two ends to be placed at least in part against a surface of a head of the drum; and at least one first and one second fastening means for fastening the set of snares to the drum, wherein the first end of the first wire is attached to the first fastening means and the second end of the first wire is attached to the second fastening means, wherein the first wire runs between the two fastening means, characterized in that a course of the first wire is shaped such that the first wire, at least along a partial section of the first wire, follows an envelope body, the envelope body having outer dimensions in an assembled state of the set of snares on the drum, the outer dimensions varying in a plane extending from the first fastening means to the second fastening means and intersecting the surface of the head of the drum.

2. The set of snares according to claim 1, wherein at least along the partial section the first wire is curved in a helical manner around the longitudinal axis of the first wire, shaped in an undulating or toothlike manner and/or has different thicknesses.

3. The set of snares according to claim 1, characterized in that the dimensions of the envelope body along the partial section from the first end in the direction of the second end first increase and subsequently decrease again.

4. The set of snares according to claim 3, characterized in that the increasing dimensions of the partial section essentially conically increase and/or the decreasing dimensions of the partial section essentially conically decrease.

5. The set of snares according to claim 1, characterized in that dimensions of the envelope body along the partial section are dimensioned such that essentially a bulge-shaped longitudinal profile of the first wire is embodied.

6. The set of snares according to claim 1, characterized in that the largest dimensions of the envelope body along the partial section are arranged essentially in the center of the longitudinal side of the first wire.

7. A drum comprising:

at least one set of snares comprising:

i) at least one elongated first wire with two ends to be placed at least in part against a surface of a head of the drum, and ii) at least one first and one second fastening means for fastening the set of snares to the drum, wherein the first end of the first wire is attached to the first fastening means and the second end of the first wire is attached to the second fastening means, wherein the first wire runs between the two fastening means, characterized in that the surface of the head of the drum, against which the elongated first wire is to be placed, at least in part, has a surface contour, and that a course of the first wire between the first and the second fastening means is shaped such that the first wire, at least along a partial section of the first wire, follows an envelope body, the envelope body having outer dimensions in an assembled state of the set of snares on the drum, the outer dimensions varying in the plane extending from the first fastening means to the second fastening means and intersecting the surface of the head of the drum correspondingly such that the envelope body along the partial section runs essentially parallel to the surface contour of the head.

8. The set of snares according to claim 1, characterized by further comprising at least one second wire having i) a first end that is attached to the first fastening means and ii) a second end that is attached to the second fastening means.

9. The set of snares according to claim 8, characterized in that the first wire and the second wire are arranged parallel to one another and/or the geometric shape of the second wire essentially corresponds to the geometric shape of the first wire.

* * * * *